US012383787B1

(12) United States Patent
Kostadis

(10) Patent No.: US 12,383,787 B1
(45) Date of Patent: Aug. 12, 2025

(54) UPRIGHT FOLDABLE TREADMILL

(71) Applicant: Andrew Kostadis, East Windsor, NJ (US)

(72) Inventor: Andrew Kostadis, East Windsor, NJ (US)

( * ) Notice: Subject to any disclaimer, the term of this patent is extended or adjusted under 35 U.S.C. 154(b) by 0 days.

(21) Appl. No.: 19/074,790

(22) Filed: Mar. 10, 2025

Related U.S. Application Data

(60) Provisional application No. 63/696,896, filed on Sep. 20, 2024.

(51) Int. Cl.
*A63B 22/02* (2006.01)

(52) U.S. Cl.
CPC ..... *A63B 22/02* (2013.01); *A63B 2210/56* (2013.01)

(58) Field of Classification Search
CPC . A63B 22/0046; A63B 22/02; A63B 71/0036; A63B 2210/00; A63B 2210/50; A63B 2210/56
See application file for complete search history.

(56) References Cited

U.S. PATENT DOCUMENTS 4,300,761 A * 11/1981 Howard ..... A63B 21/4029 482/130
4,757,987 A * 7/1988 Allemand ..... A63B 22/02 482/54
5,393,287 A * 2/1995 Papapaschalis ..... A61H 15/00 601/24
5,813,947 A * 9/1998 Densmore ..... A63B 22/02 482/52
6,224,516 B1 * 5/2001 Disch ..... A63B 22/02 482/54
6,830,540 B2 * 12/2004 Watterson ..... A63B 22/0235 482/54
10,589,147 B1 * 3/2020 Kostadis ..... A63B 22/025
11,285,361 B1 * 3/2022 Kostadis ..... A63B 22/02
2007/0191190 A1 * 8/2007 Kuo ..... A63B 22/0023 482/54
2008/0234111 A1 * 9/2008 Packham ..... A63B 22/02 482/54
2008/0280734 A1 * 11/2008 Dickie ..... A63B 22/0023 482/54
2009/0111664 A1 * 4/2009 Kau ..... A63B 22/02 482/54
2019/0290956 A1 * 9/2019 Ren ..... A63B 22/02
2021/0299512 A1 * 9/2021 Kostadis ..... A63B 22/025
2023/0014949 A1 * 1/2023 Jiang ..... A63B 22/0235
2024/0408443 A1 * 12/2024 Jia ..... A63B 22/02

* cited by examiner

*Primary Examiner* — Gary D Urbiel Goldner
(74) *Attorney, Agent, or Firm* — SLEMAN & LUND LLP

(57) ABSTRACT

A foldable treadmill is designed to automatically collapse into an upright position for compact storage and efficient space utilization. Featuring small wheels and a low-profile upright form, it can be seamlessly rolled and stored beneath or adjacent to a desk, minimizing spatial intrusion and preserving legroom for seated users. The treadmill transitions automatically from its upright storage position to a deployed configuration on the floor, positioned for convenient use in front of a workstation. Engineered to facilitate low-speed walking while working, it supports an active and ergonomic work environment. Compatible with both height-adjustable and standard fixed-height desks, this innovative treadmill enables users to integrate movement into their daily routines, mitigating the adverse effects of prolonged sedentary behavior and promoting workplace health and productivity.

5 Claims, 3 Drawing Sheets

UPRIGHT FOLDABLE TREADMILL

CROSS-REFERENCE DATA

The present application claims the priority date benefit from the U.S. Provisional Patent Application No. 63/696,896 filed Sep. 20, 2024 by the same inventor and with the same title, which is incorporated herein in its entirety by reference.

FIELD OF THE INVENTION

This invention relates to the collapsed state of the foldable treadmill. Typically, foldable treadmills require manual folding and the final foldable position is horizontal i.e., flat to the floor surface. This invention proposes automated foldability and the upright final foldable position of the treadmill.

BACKGROUND

Modern society experienced tremendous industrial change. During the last 50-70 years the number of sedentary workers has risen and the extent of physical labor dropped dramatically. Office workers spend most of their day sitting in front of a computer screen while the human body needs movements. In response, the industry of sports facilities and equipment has been established. The main idea of this invention is to provide sedentary workers with the possibility to walk while working on the computer, allowing office workers to maintain a healthy work-life balance and promote overall well-being.

SUMMARY OF THE INVENTION

Existing treadmills are not suitable for commercial offices since they are bulky and require significant effort to employ/deploy the equipment. Upright automatic folding opens new opportunities for the convenience of users and further automation. The upright foldable treadmill can be easily stored under the working desk or anywhere in the room as soon as both ends of the treadmill are equipped with wheels. Wheels allow to roll the upright folded treadmill to the suitable storage space.

One obstacle still remains since the limited clearance between the floor and the bottom surface of the desk. American standard is 27". This invention proposes that foldable treadmills have three or more sections. Three or more sections make the upright treadmill shorter and easily fit under any standard office desk.

DETAILED DESCRIPTION OF THE PREFERRED EMBODIMENT

Figure 1:
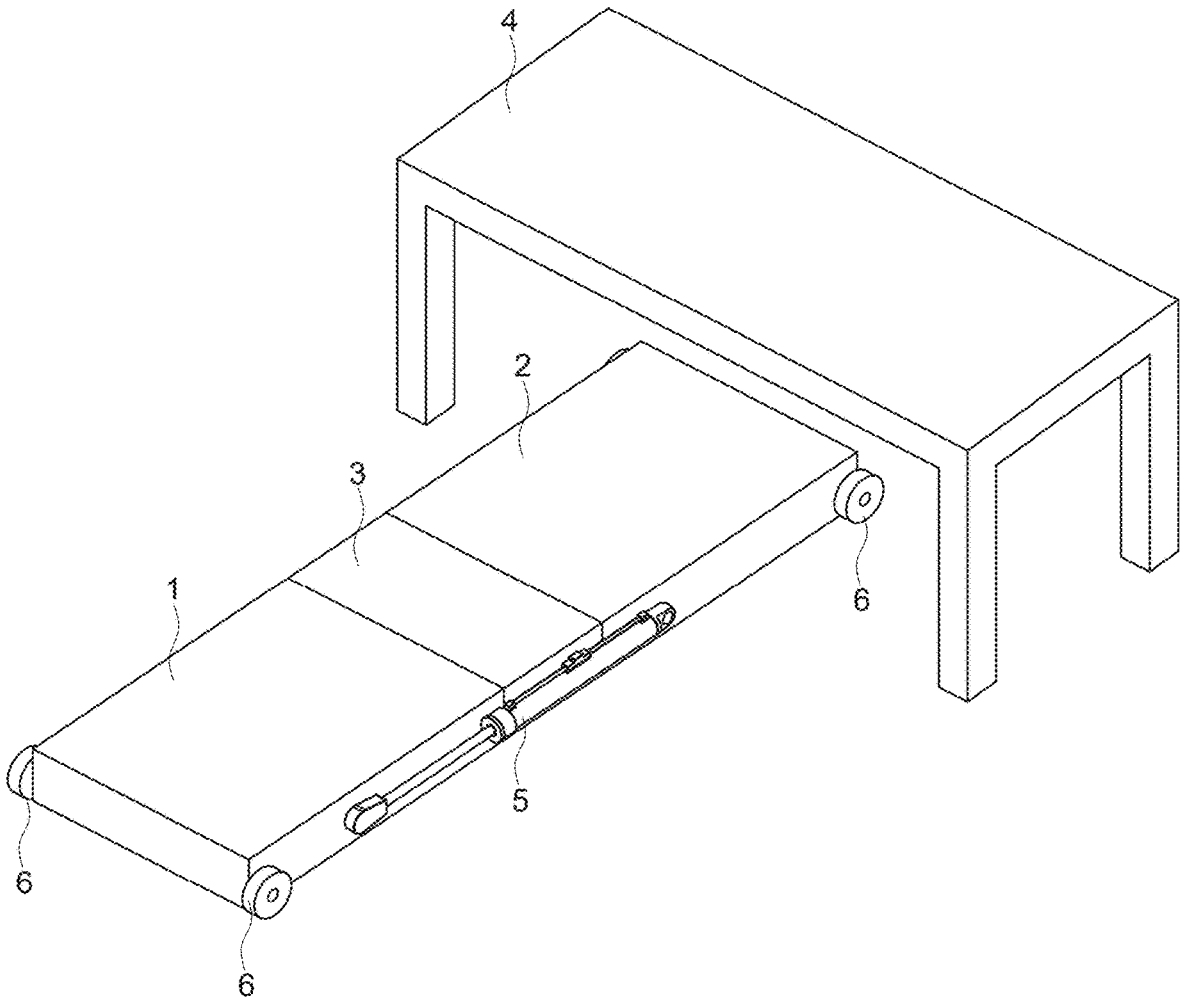
FIG. 1 presents a foldable treadmill in the working position. This deployed state is flat on the floor, in front of the office desk. In this position, the user can walk and work on a computer. Two linear actuators on both sides of the treadmill are folding and unfolding the treadmill. Wheels are attached to the outer and inner ends of the foldable treadmill.

While in the working position (deployed state), an upright treadmill provides a "walk while working" opportunity to a sedentary worker. The working position is flat on the floor, in front of the working desk 4. The outer segment 1 disposed distal the desk while the treadmill is in the working position. The inner segment 2 is proximate to the desk. In working position; this segment may partly come under the desk providing the most comfortable position for the user. The middle section 3 is between the sections 1 and 2.

Figure 2:
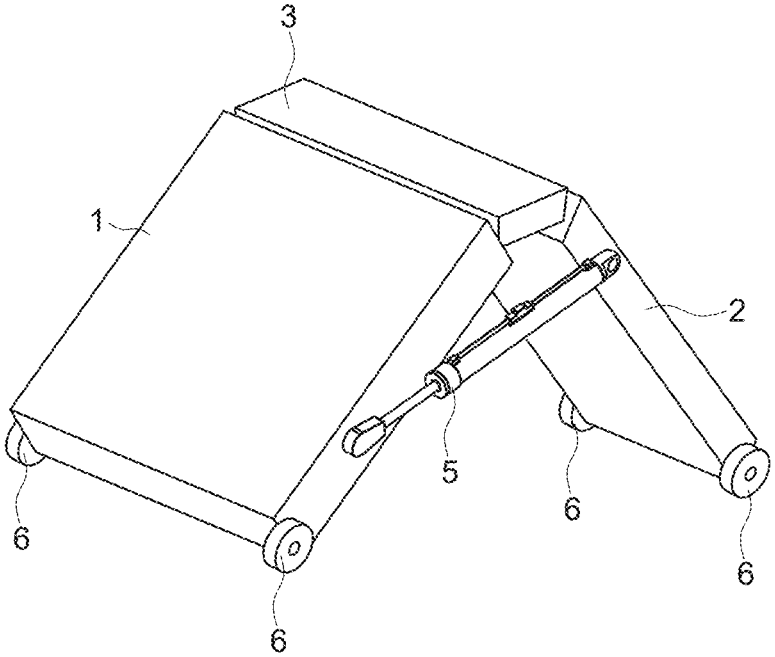
FIG. 2 presents the transitional position between the working position (flat on the floor) and the upright folding position. The desk is omitted.

After the working session is over, the user steps out of the treadmill. The treadmill is ready to be folded into the upright position. Two linear actuators 5 are attached on both sides of the treadmill actuating the folding. The wheels 6 at both ends of the treadmill provide smoother folding. The transitional position is shown on the FIG. 2 and the final upright position is shown on the FIG. 3. The reverse unfolding process is represented by the sequence of FIG. 3, FIG. 2, and FIG. 1.

The linear actuators on both sides of the treadmill could be attached differently. Actuators could be hingedly attached to both ends of sections 1 and 2. Several other combinations are possible. Any particular design can use a different number of linear actuators or other types of motors to provide the folding.

Figure 3:
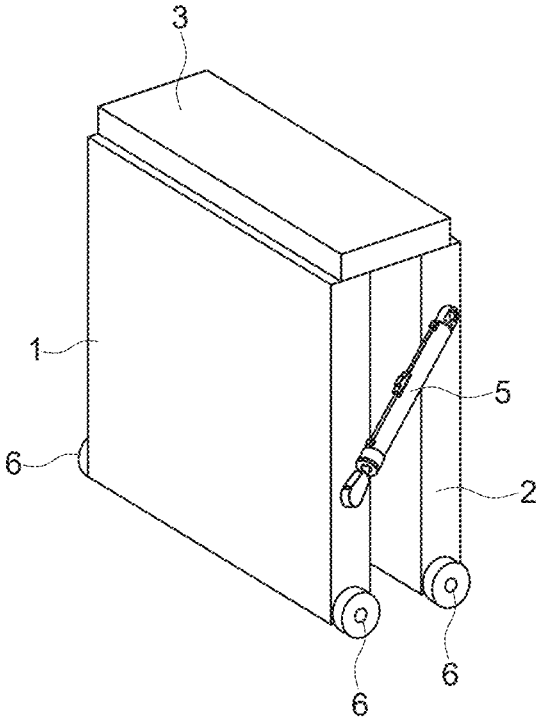
FIG. 3 presents the folding upright position of the treadmill. The desk is omitted.

The folded upright position is shown on the FIG. 3. In this position treadmill is ready to be rolled to a storage position. The storage could be manual or further automated. The treadmill can fit under the desk or be rolled outside the desk.

In case the user stores the treadmill outside the desk, the middle section 3 is not necessary. This solution can lower the overall cost of the upright foldable treadmill.

What is claimed is:

1. A treadmill for use with a desk and being configured to fold into an upright position from a deployed state, the treadmill comprising:

an inner segment positioned proximate to the desk when the treadmill is in the deployed state;

an outer segment positioned distally to the desk and aligned with the inner segment when the treadmill is in the deployed state;

a middle segment hingedly connected at a first end to the inner segment and at a second, opposite end to the outer segment;

two telescoping linear actuators, each of the two telescoping linear actuators being attached at only two points, including to the inner segment at a first end of the corresponding telescoping linear actuator and to the outer segment at a second end of the corresponding telescoping linear actuator and being configured to facilitate folding of the treadmill into the upright position; and wheels positioned at opposing ends of the treadmill to enable mobility of the treadmill.

2. The treadmill of claim 1, wherein the middle segment comprises two sub-segments.

3. The treadmill of claim 1, wherein the two telescoping linear actuators are not directly coupled to the middle segment.

4. The treadmill of claim 1, wherein each of the two telescoping linear actuators includes a telescoping arm receivable within a cylinder.

5. The treadmill of claim 1, wherein the first end of each telescoping linear actuator is disposed a first fixed distance from the middle segment, and the second end of each telescoping linear actuator is disposed a second fixed distance from the middle segment, the second fixed distance being larger than the first fixed distance.

* * * * *